US010309176B2

(12) United States Patent
Allmaras et al.

(10) Patent No.: US 10,309,176 B2
(45) Date of Patent: Jun. 4, 2019

(54) PUMP DOWN CONVEYANCE

(71) Applicant: Schlumberger Technology Corporation, Sugar Land, TX (US)

(72) Inventors: Ronald Clemence Allmaras, Tuttle, OK (US); Roger A. Post, Sugar Land, TX (US); Martin Leonard, Perth (AU)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 225 days.

(21) Appl. No.: 14/653,198

(22) PCT Filed: Dec. 16, 2013

(86) PCT No.: PCT/US2013/075276

§ 371 (c)(1),
(2) Date: Jun. 17, 2015

(87) PCT Pub. No.: WO2014/099723

PCT Pub. Date: Jun. 26, 2014

(65) Prior Publication Data

US 2015/0330172 A1 Nov. 19, 2015

Related U.S. Application Data

(60) Provisional application No. 61/738,479, filed on Dec. 18, 2012.

(51) Int. Cl.
*E21B 23/08* (2006.01)
*E21B 23/14* (2006.01)

(52) U.S. Cl.
CPC ..... *E21B 23/08* (2013.01); *E21B 23/14* (2013.01)

(58) Field of Classification Search
CPC ..... E21B 23/14; E21B 23/08; E21B 47/0006; E21B 17/06
See application file for complete search history.

(56) References Cited

U.S. PATENT DOCUMENTS 2,589,599 A * 3/1952 Bond ..... E21B 31/00 336/136
2,794,951 A * 6/1957 Broding ..... E21B 47/04 318/653
3,327,784 A * 6/1967 Pardue ..... E21B 31/00 166/125
3,373,817 A * 3/1968 Cubberly, Jr. ..... E21B 31/00 166/243

(Continued)

FOREIGN PATENT DOCUMENTS

GB 2275778 A * 9/1994 ..... E21B 44/02
WO 20140099723 A1 6/2014

OTHER PUBLICATIONS

The Free Dictionary, "Dynamically", downloaded Sep. 4, 2018, 3 pages (Year: 2018).*

(Continued)

*Primary Examiner* — Jennifer H Gay
(74) *Attorney, Agent, or Firm* — Eileen Pape

(57) ABSTRACT

A cable that includes outer cable jacketing located about a conductor layer. The conductor layer includes cable elements that are resistant to compression and a plurality of compression-resistant members.

8 Claims, 5 Drawing Sheets

(56) References Cited

U.S. PATENT DOCUMENTS 3,402,601 A * 9/1968 Heineman ..... E21B 47/0006 73/862.392
3,490,149 A * 1/1970 Bowers ..... E21B 47/04 340/854.1
3,957,118 A * 5/1976 Barry ..... E21B 17/003 166/385
4,265,110 A * 5/1981 Moulin ..... E21B 47/0006 73/1.08
4,269,063 A * 5/1981 Escaron ..... E21B 47/0006 73/152.59
5,353,877 A * 10/1994 DeCorps ..... E21B 23/02 166/373
6,032,733 A * 3/2000 Ludwig ..... E21B 17/023 166/385
6,431,269 B1 * 8/2002 Post ..... E21B 17/023 166/242.7
7,187,620 B2 * 3/2007 Nutt ..... G01V 1/40 166/66
7,343,979 B2 * 3/2008 Dreggevik ..... E21B 17/023 166/377
7,637,321 B2 12/2009 Zazovsky et al.
7,661,477 B2 2/2010 Sheiretov et al.
7,690,423 B2 4/2010 Del Campo et al.
7,874,372 B2 1/2011 Varkey et al.
8,978,749 B2 * 3/2015 Rodgers ..... E21B 41/0092 166/297
9,657,540 B2 * 5/2017 Coles ..... E21B 21/08
2003/0179651 A1 * 9/2003 Nutt ..... G01V 1/40 367/25
2004/0020646 A1 * 2/2004 Flecker ..... E21B 43/04 166/253.1
2007/0165487 A1 * 7/2007 Nutt ..... E21B 31/18 367/25
2009/0020294 A1 * 1/2009 Varkey ..... E21B 47/0006 166/385
2010/0006279 A1 1/2010 Martinez et al.
2010/0181072 A1 7/2010 Gillan
2012/0145396 A1 6/2012 Fisher et al.
2012/0279322 A1 * 11/2012 Ratcliffe ..... E21B 47/0006 73/862.627
2013/0000892 A1 * 1/2013 Ives ..... B66D 1/58 166/250.01
2013/0138254 A1 * 5/2013 Seals ..... E21B 23/08 700/282
2013/0168078 A1 * 7/2013 McCarter ..... E21B 31/007 166/66.4
2013/0168083 A1 * 7/2013 McCarter ..... E21B 23/00 166/250.01
2015/0027736 A1 * 1/2015 Smaardyk ..... E21B 47/0006 166/381
2015/0167414 A1 * 6/2015 Coles ..... E21B 45/00 166/250.01
2015/0330172 A1 * 11/2015 Allmaras ..... E21B 23/14 166/250.01
2016/0003033 A1 * 1/2016 Coles ..... E21B 41/0021 73/152.58

OTHER PUBLICATIONS

International Search Report for International Application No. PCT/US2013/075276 dated Mar. 27, 2014.

* cited by examiner

PUMP DOWN CONVEYANCE

BACKGROUND

The present disclosure is related in general to wellsite equipment such as oilfield surface equipment, downhole assemblies, and the like.

The present disclosure relates generally to pump down conveyance of wireline and/or slickline tools including, but not limited to, the conveyance of perforating guns.

Generally, this disclosure describes methods for improving the efficiency of pump down operations in wellbores having longer horizontal sections and/or higher curvature, deviated, and/or horizontal wellbores.

One of the problems encountered while conveying downhole tools by pumping them down in the well is the unintentional pull off of the wireline or slickline cable at the weak point at the top of the toolstring. A weak point is highly desirable in cases where the toolstring becomes stuck in the well, and must be retrieved with a fishing tool. The weak point is installed to ensure that when over-pulling on the cable, the weak point breaks at the top of the toolstring if the toolstring is stuck, such that the cable may be removed from the well before fishing. The more extended the reach of the well is, the higher the tension of the cable must be to exceed the frictions forces between the cable and the sidewall of the well, and therefore the lower the tension rating of the weak point must be to insure mechanical integrity of the cable over its entire length. Lowering the tension rating of the weak point makes unintentional pull off more likely when the tool is pumped down.

It remains desirable to provide improvements in oilfield surface equipment and/or downhole assemblies.

SUMMARY

An example method of conveying downhole equipment includes providing pressure to a wellbore to convey a toolstring connected with a cable; and measuring tension in the cable proximate a top of the toolstring; wherein if the toolstring is being conveyed the toolstring remains connected with the cable regardless of measured tension in the cable proximate to the top of the toolstring, and wherein if the cable is being retrieved the downhole equipment is released from the cable if the measured tension in the cable proximate the top of the toolstring is too large.

An example system for monitoring and controlling a downhole operation includes a toolstring connected with a cable by a release device. The release device is configured to release the toolstring from the cable upon receipt of a release signal from the control logic. The system also includes a sensor operatively located adjacent a top of the toolstring for measuring tension in the cable.

The system can also have control logic in communication with the release device and the sensor. The control logic is configured to send the release signal to the release device during deployment of the toolstring if the sensor measures tension in the cable that is too large.

DETAILED DESCRIPTION OF THE INVENTION

Figure 1:
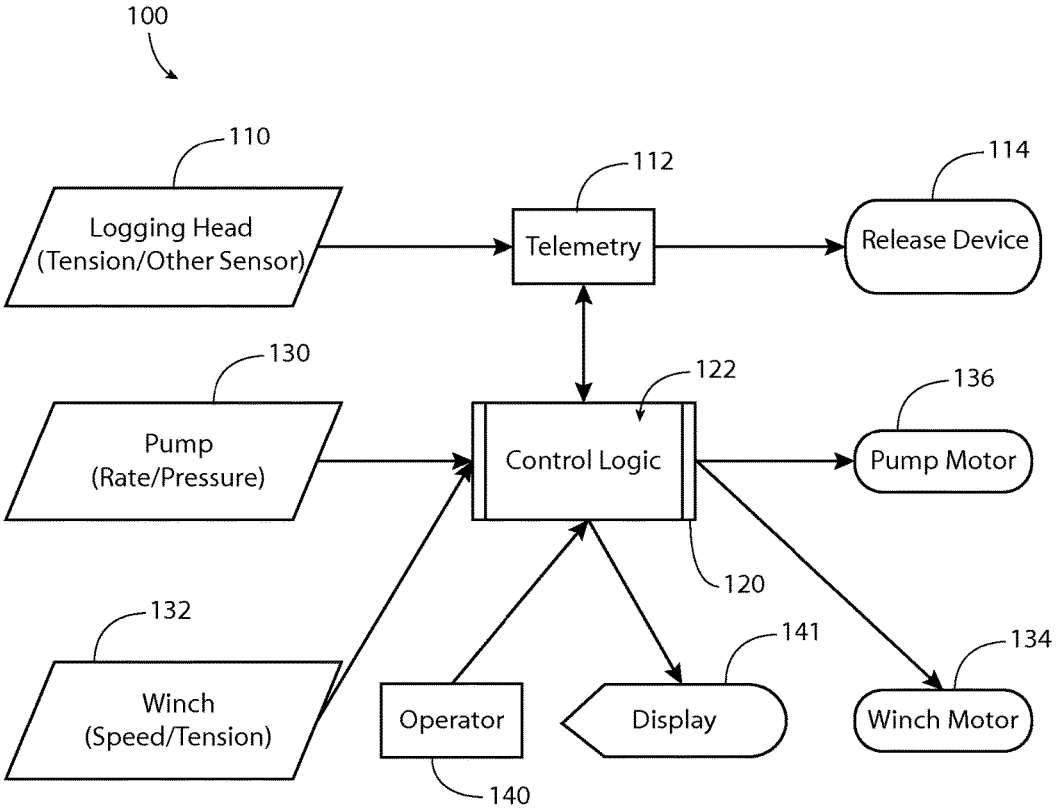
FIG. 1 depicts an embodiment of a system for pump down conveyance.

Certain examples are shown in the above-identified figures and described in detail below. In describing these examples, similar or identical reference numbers are used to identify common or similar elements. The figures are not necessarily to scale and certain features and certain views of the figures may be shown exaggerated in scale or in schematic for clarity and/or conciseness.

An example method of pump down conveyance includes lowering in a well a toolstring connected to a cable by applying pressure to a pump down head via a pump located at a wellbore surface; measuring a cable tension at a downhole location proximate the top of the toolstring; transmitting the measured cable tension to an operator at the wellbore surface; unlatching the cable from the toolstring if the downhole cable tension is above a threshold when the toolstring is reeled in; and not unlatching the cable from the toolstring even if the downhole cable tension is above the threshold when the toolstring is pumped down. Detaching the cable from the toolstring may be performed by sending a command to an electrically controlled release device.

Another example method can include controlling the rate of the pump based on the downhole cable tension. The method may also include measuring a cable tension at a surface location proximate the winch, and controlling the rate of the pump and the rotation of the winch based on the downhole and surface cable tensions.

Controlling the pump or the winch may be automated and performed by an electronics controller, or the operation and control of the pump or the winch may be performed by an operator.

The control may be performed by an operator making decision in view of data displayed on a monitor, or it may be performed automatically by a controller, utilizing suitable equipment for monitoring data and controlling surface equipment or the like.

The control inputs comprise downhole data, for example measured by sensors disposed proximate the top of the toolstring, such as in the logging head. Typically, downhole data may comprise downhole cable tension measured at the logging head. Other downhole data can include wellbore pressure, wellbore temperature, etc., as will be appreciated by those skilled in the art with the aid of this dislcsoure.

The control inputs may also comprise surface data, for example measured by sensors disposed at the well site. Typically, surface data include winch direction (or winch speed). Other surface data may also include uphole cable tension measured at the winch, the rate of the pump used to pump the toolstring down, and pressure at the pump.

The control logic utilizes downhole and surface data, so the data are gathered in one convenient location, typically at the surface. For example the downhole data are telemetered and displayed to the operator and/or gathered by the controller, together with the surface data.

The control outputs include downhole commands, for example sent to downhole actuators disposed proximate the top of the toolstring, such as in the logging head. Downhole commands may be sent to an electrically controlled release device. Other downhole commands could be sent to an unsticking device or another downhole device as part of the toolstring.

The control outputs may also include commands sent to surface actuators disposed at the well site. The control outputs could include commands sent to the pump used to pump the toolstring down or to the winch.

FIG. 1 depicts an embodiment of a system for pump down conveyance.

The system 100 can include a logging head 110. The logging head 110 can have any number of sensors. The sensors can be for measuring downhole tension in the cable or other parameters related to downhole parameters of the toolstring, cable, or wellbore. The downhole parameters can be acceleration of the toolstring, wellbore pressure, wellbore temperature, or the like. The toolstring may also be referred to herein as a downhole tool. The toolstring can have any number of components or tools connected together.

A release device 114 can be connected with the logging head 110. The logging head 110 can also be connected with a telemetry module 112. The telemetry module 112 is in communication with the sensors of the logging head 110 and the release device 114.

A control 120 with control logic 122 can be in communication with the telemetry module 112, a pump motor 136, a pump 130, a winch 132, and a winch motor 134. The control logic 122 can be configured to perform any of the methods described herein.

An operator 140 can see operation conditions on a display 141. In an embodiment, the operator 140 can use the information on the display 141 to control the conveyance and retrieval of the toolstring. In another embodiment, the control logic can receive information from the sensors, pump motor 136, pump 130, winch 132, winch motor 134, and use that data to control the conveyance and retrieval of the toolstring.

Figure 2:
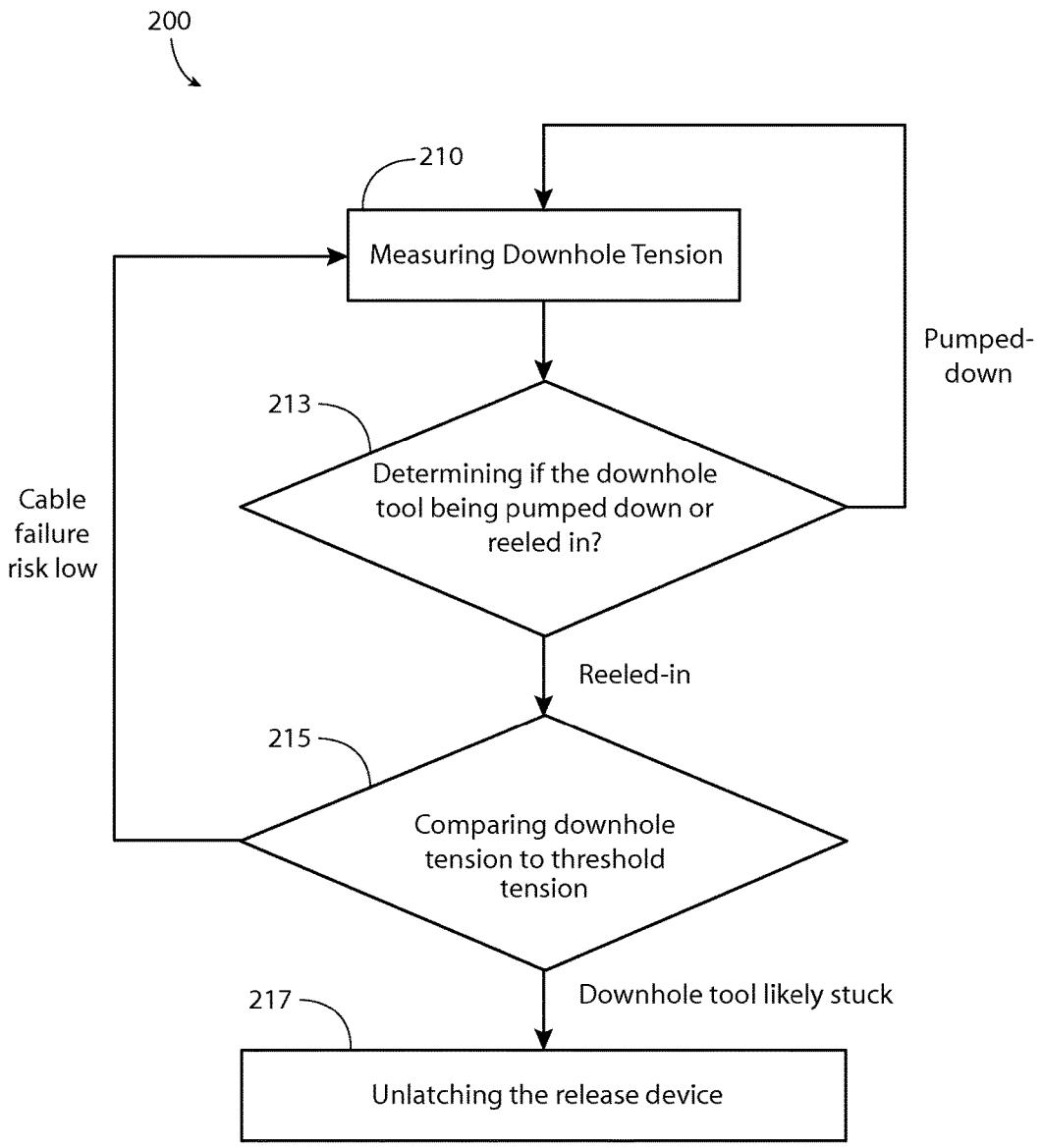
FIG. 2 depicts flow diagram of a method of pump down conveyance.

FIG. 2 depicts flow diagram of a method of pump down conveyance. T

The method 200 includes measuring downhole tension (Block 210). The downhole tension can be measured using a sensor that is proximate to the toolstring. The sensor can send a tension signal a controller and the controller can use calibration data to determine the downhole tension.

The method 200 also includes determining if the downhole tool is being pump down or reeled in (Block 213). For example, the controller can receive a signal from an operator indicating if conveyance or retrieval is occurring, or in another embodiment a sensor such as an accelerometer can be send a direction signal to the controller, which can used preinstalled calibration data to determine if conveyance or retrieval is occurring.

The method 200 also includes comparing downhole tension to threshold tension (Block 215) if the downhole tool or toolstring is being retreived; however, if the downhole tools is being conveyed the method loops back to measuring downhole tension (Block 210). The threshold tension can be a predetermined working break strength for the cable. The threshold tension can change as the toolstring moves through the well; therefore, the control can use know techniques and methods to dynamically determine the threshold tension.

The method also included unlatching the release device (Block 217) if the downhole tool is likely stuck or cable failure is likely; however, if the comparison indicates cable failure risk is low then the method loops back to measuring the downhole tension (Block 210). Unlatching the release device can include sending a signal to the release device when the downhole tension is larger than the threshold tension.

Figure 3:
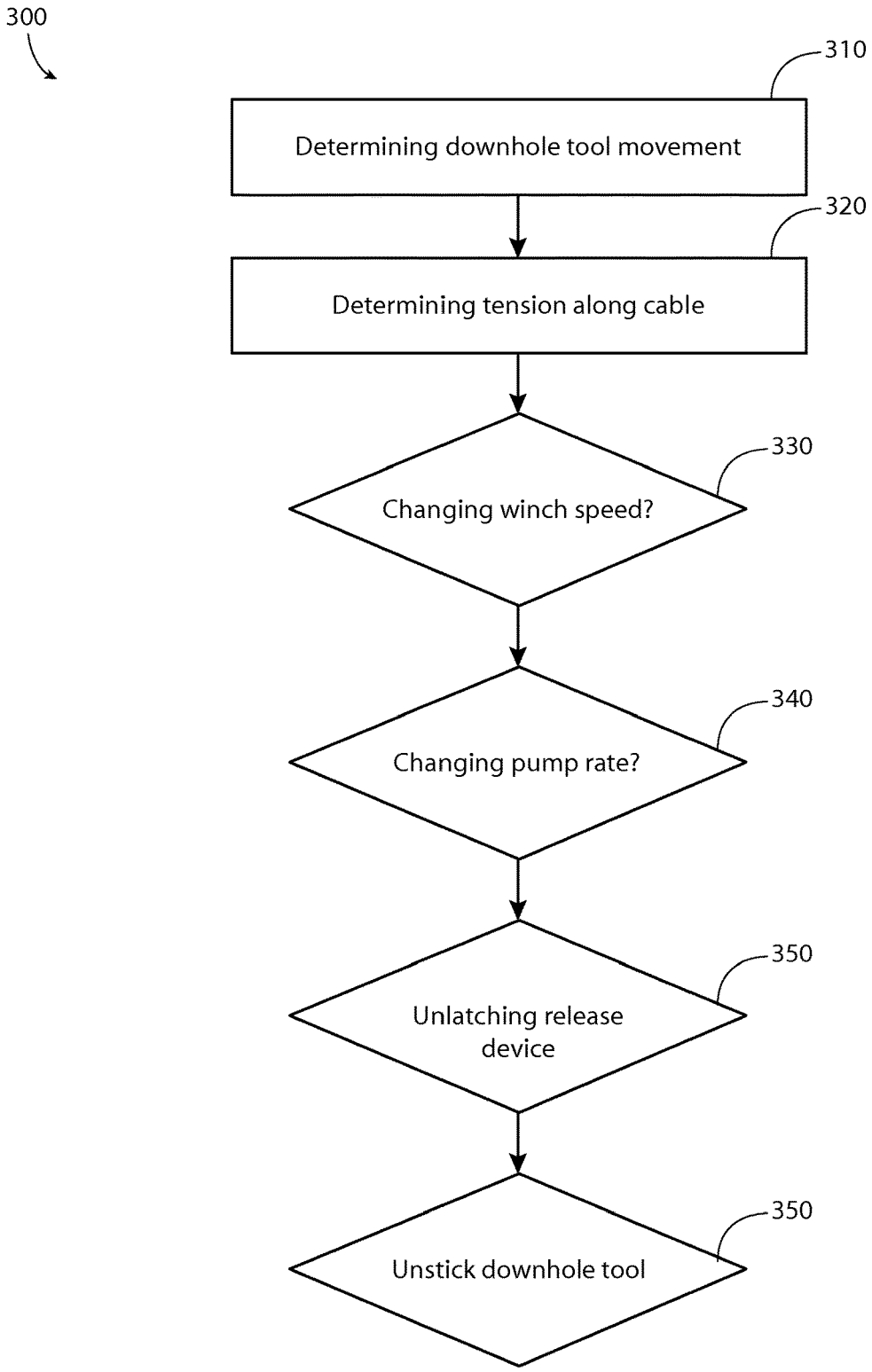
FIG. 3 depicts a general schematic of a method of monitoring and controlling a downhole operation.

FIG. 3 depicts a general schematic of a method of monitoring and controlling a downhole operation.

The method 300 includes determining downhole tool movement (Block 310). The movement of the downhole tool (pumped down or reeled in) can be determined by utilizing the winch speed or other sensors. The method also include determining tension along the cable (Block 310). The tension along the cable can also be computed. The tension along the cable can change. For example, the tension changes depending on the tool movement, change in the direction of drag forces, and location of the tool in the well. To compute the tension, data other than the tool movement may be used, such as, but not limited to, uphole and/or downhole cable tension, pressure applied to pump down head, pump pressure at the well site, or the like, as will be appreciated by those skilled in the art.

Based on the cable tension computed along the cable, the method can include changing winch speed (Block 330), changing pump rate (Block 340), Unlatching the release device (Block 350), and/or unsticking the downhole tool (Block 360). For example, control logic can determine if the winch speed and/or the pump rate should be modified to prevent cable failure or to increase the speed of the tool as it progresses along the wellbore. Also, the control logic can determine if the electrically release device should be unlatched, and/or if an unsticking device should be actuated. The control logic can use predetermined operational parameters, calibration data, cable data, and predetermined mathematical formulas to make the control determinations.

As an example of the generalized logic. When reeling in, the cable tension increases towards the surface, either because of cable drag in the deviated section, and/or because of cable weight in the horizontal section. The point of highest cable tension is usually uphole, and the decision to unlatch the ECRD may be taken or initiated based on the uphole cable tension measured at the winch and a cable failure threshold. The threshold may be updated to take into account uncertainty in the drag forces on the cable, to increase a safety margin in case of debris or the like.

When pumping down, the cable tension may decrease towards the surface in the deviated section because of cable drag, and increases again towards the surface in the horizontal section because of cable weight. The point of highest cable tension is usually downhole, and the decision to unlatch the ECRD may be taken based on the downhole tension measured at the logging head and a cable failure threshold. The threshold can be updated to take into account uncertainty in the drag forces on the cable, or the like.

Figure 4:
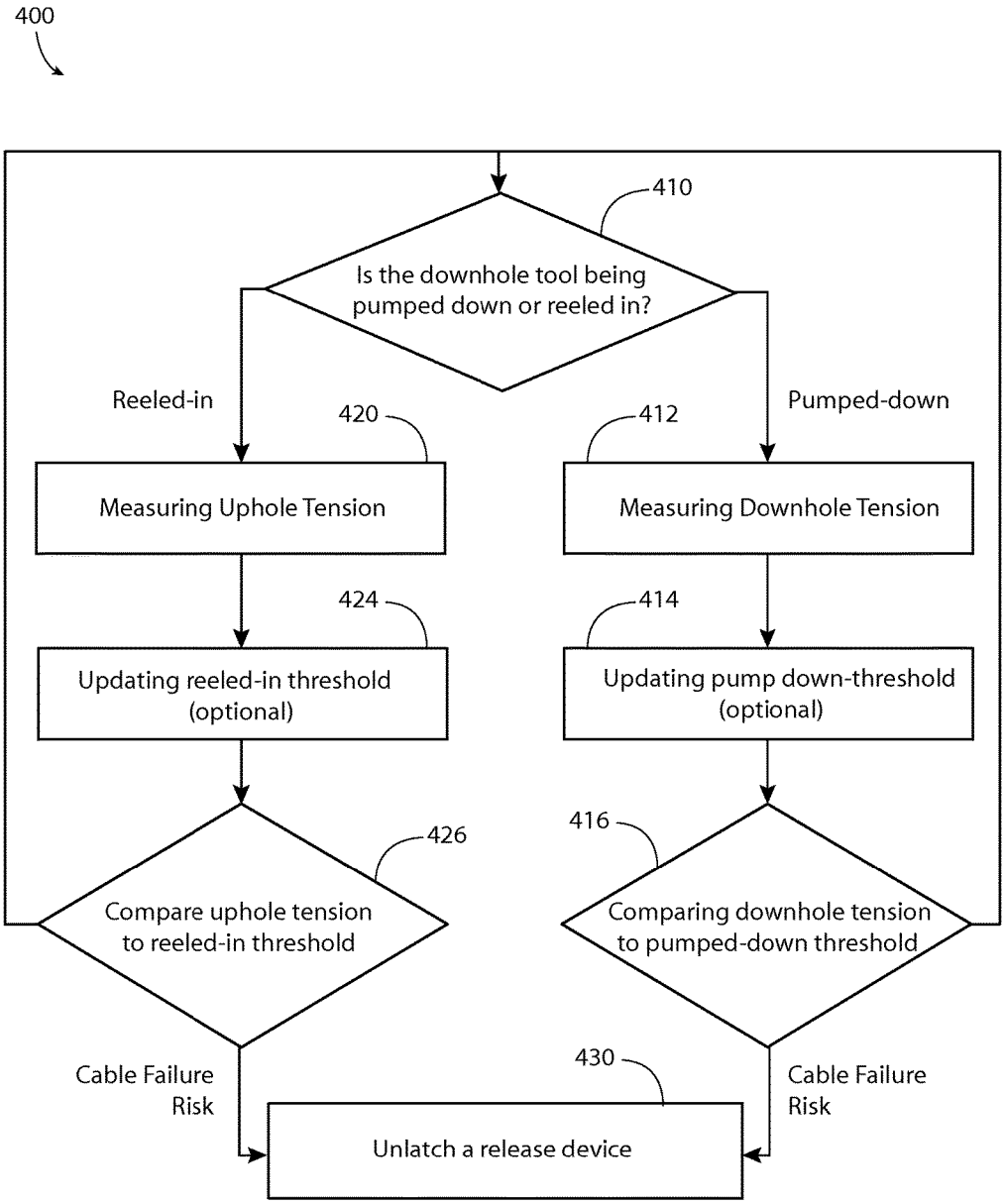
FIG. 4 depicts another schematic of an embodiment of a method of conveying and retrieving downhole equipment.

FIG. 4 depicts another schematic of an embodiment of a method of conveying and retrieving downhole equipment.

The method 400 can include determining if the downhole tool is being pumped down or reeled in (Block 410).

Upon a determination that the downhole tool is being pumped down the method includes measuring downhole tension (Block 412) and updating pump down-threshold (Block 414). Measuring downhole tension and updating the pump down-threshold can be done using techniques disclosed herein or other techniques that are now known or known in the future. These techniques and implantation thereof would be known to one skilled in the art with the aid of this disclosure. The method also includes comparing downhole tension to pump down-threshold (Block 416). The method 300 can loop back to determining if the downhole tool is being pumped down or reeled in (block 410) when cable failure risk is low, or the method 300 can include unlatching a release device (Block 430).

Upon a determination that the downhole tool is being reeled in, the method 300 includes measuring the uphole tension (Block 420) and updating the reeled-in threshold (Block 424). The method also includes comparing uphole tension to reeled-in threshold (Block 426). Upon a determination that there is no cable failure risk the method loops back to (Block 410); however, if cable failure risk is determined the method continues to (Block 420).

Figure 5:
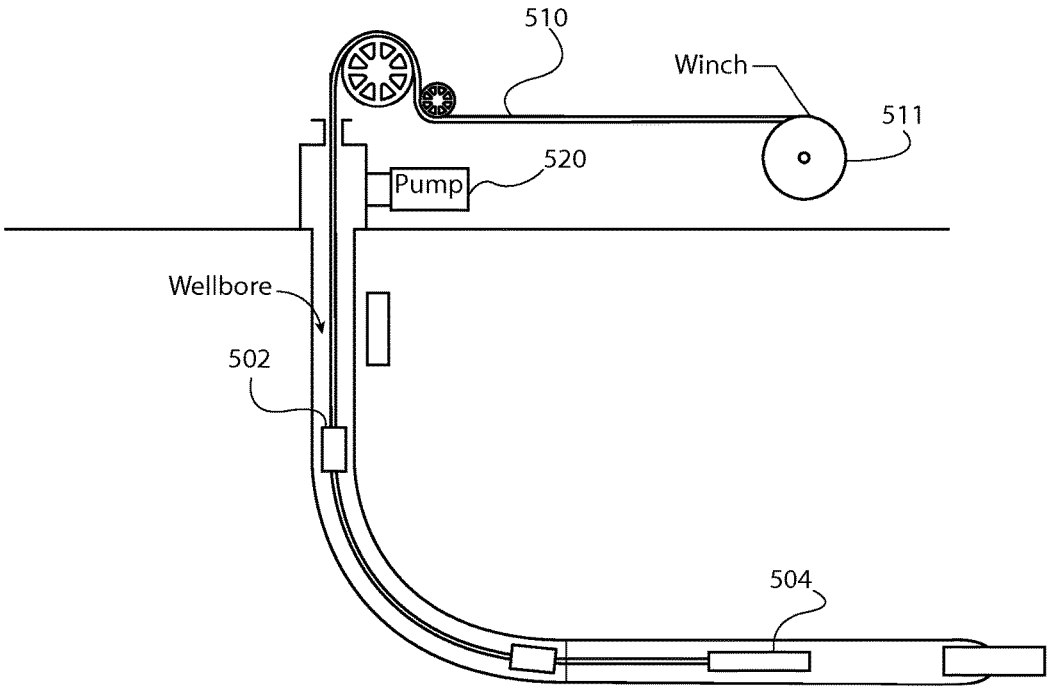
FIG. 5 depicts a toolstring in a wellbore.

FIG. 5 depicts a toolstring in a wellbore.

The toolstring 504 can be conveyed into a wellbore 502 using pump down head provided by pump 520. The toolstring 504 can be connected with a cable 510. The cable 510 is connected to a winch 511. The winch 511 and cable 510 can be used to retrieve the toolstring 504. The tension on the cable will be higher near the toolstring 504 during pump down and near the surface during retrieval. The tension on the cable can change depending on the wellbore shape, the pump down rate, and other factors. For example, when pumping down the cable tension decreases towards the surface in the deviated section because of cable drag, and increases again towards the surface in the horizontal section because of cable weight.

Although example assemblies, methods, systems have been described herein, the scope of coverage of this patent is not limited thereto. On the contrary, this patent covers every method, apparatus, and article of manufacture fairly falling within the scope of the appended claims either literally or under the doctrine of equivalents.

What is claimed is:

1. A method of conveying downhole equipment, wherein the method comprises:

providing pressure to a wellbore to convey a toolstring comprising downhole equipment, wherein the toolstring is connected with a cable; and measuring tension in the cable proximate a top of the toolstring;

wherein a controller with control logic is configured to receive the measured tension and also determine if the toolstring is being conveyed or retrieved, and wherein the controller issues a command to an electrically controlled release device to release the toolstring when the control logic determines that the toolstring is being retrieved and that the measured tension exceeds a dynamically determined threshold tension force, and wherein the control logic loops back to receiving the measured tension during conveyance and does not release the toolstring when the control logic determines that the toolstring is being conveyed.

2. The method of claim 1, further comprising adjusting the rotation of a winch based on measured tension in the cable.

3. The method of claim 1, wherein the control logic determines if the toolstring is being deployed or retrieved based on an accelerometer connected with the toolstring.

4. A system for monitoring and controlling a downhole operation, wherein the system comprises:

a toolstring connected with a cable by a release device, wherein the release device is configured to release the toolstring from the cable upon receipt of a release signal from a controller;

a sensor operatively located adjacent a top of the toolstring for measuring tension in the cable adjacent the toolstring; and control logic in the controller and in communication with the release device and the sensor;

wherein the control logic is configured to determine if the release device is being retrieved and instruct the controller to send the release signal to the release device during retrieval of the toolstring if the sensor measures tension in the cable that exceeds a predetermined force, and wherein the control logic loops back to receiving the measured tension even if the tension exceeds the predetermined force if the control logic determines that the toolstring is being conveyed.

5. The system of claim 4, further comprising a winch in communication with the control logic, wherein the control logic calculates tension along at least a portion of the cable, receives measured tension from the sensor, or combinations thereof and controls the winch speed in response to the tension.

6. A system for conveying a toolstring, wherein the system comprises:

a winch, wherein the winch has a cable connected with the toolstring;

a pump for providing pressure to deploy the toolstring;

a plurality of measuring devices, wherein one of the measuring devices of the plurality of measuring devices is located on the toolstring adjacent the cable for measuring cable tension at the toolstring, at least another measuring device is configured to measure uphole tension, and at least another measuring device of the plurality of measuring devices is configured to measure pump pressure; and a controller in communication with the plurality of measuring devices, the pump, and the winch;

wherein the controller is configured to automatically adjust at least one of the pump or winch during conveyance to maintain cable tension below a dynamically determined cable failure threshold, and wherein the controller is configured to automatically adjust the winch if cable tension exceeds the dynamically determined cable failure threshold during conveyance, and wherein the controller is configured to automatically cause the release of the toolstring if cable tension exceeds the dynamically determined cable failure threshold during retrieval.

7. The system of claim 6, further comprising: a logging head connecting the cable to the toolstring, and wherein a release device is connected with the logging head, and wherein the measuring devices located on the toolstring adjacent the cable for measuring cable tension at the toolstring is located in the logging head.

8. The system of claim 6, further comprising: an unsticking device connected with the cable.

* * * * *